US006619006B1

(12) United States Patent
Shirota

(10) Patent No.: US 6,619,006 B1
(45) Date of Patent: Sep. 16, 2003

(54) ROOFING SHINGLE

(76) Inventor: Muneyasu Shirota, 2-39-2, Nakama, Urasoe-shi, Okinawa, 901-2103 (JP)

( * ) Notice: Subject to any disclaimer, the term of this patent is extended or adjusted under 35 U.S.C. 154(b) by 0 days.

(21) Appl. No.: 10/107,191

(22) Filed: Mar. 28, 2002

(51) Int. Cl.[7] ..... E04D 1/34

(52) U.S. Cl. ..... 52/520; 52/533; 52/539; 52/545; 52/546; 52/579; 52/444; 52/446; 52/447; 52/448; 52/409; 52/410; 52/411; 52/412; 52/413; 52/519; 52/528; 52/536; 52/538; 52/554; 52/555; 52/556; 52/557; 52/58; 52/60; 52/90.1

(58) Field of Search ..... 52/533, 539, 545, 52/546, 579, 444, 446, 447, 448, 409, 410, 411, 412, 413, 519, 520, 528, 536, 538, 554, 555, 556, 557, 58, 60, 90.1

(56) References Cited

U.S. PATENT DOCUMENTS

| | | | | | |
|---|---|---|---|---|---|
| 359,959 | A | * | 3/1887 | Cortright | 52/531 |
| 889,818 | A | * | 6/1908 | Sherman | 52/531 |
| 1,483,882 | A | * | 2/1924 | Harvey | 52/544 |
| 1,515,749 | A | * | 11/1924 | Olsson | 52/523 |
| 1,536,932 | A | * | 5/1925 | Rolfe | 52/443 |
| 1,861,998 | A | * | 6/1932 | Bennett | 52/96 |
| 2,004,198 | A | * | 6/1935 | Fall | 52/536 |
| 2,149,818 | A | * | 3/1939 | North | 52/409 |
| 2,160,642 | A | * | 5/1939 | Bumpas et al. | 52/95 |
| 2,164,712 | A | * | 7/1939 | Kirschbraun | 52/540 |
| 2,264,564 | A | * | 12/1941 | Ochs | 52/521 |
| 2,482,835 | A | * | 9/1949 | Bremer | 52/533 |
| 2,511,083 | A | * | 6/1950 | Small | 52/547 |
| 2,601,833 | A | * | 7/1952 | Olson | 52/94 |
| 2,631,552 | A | * | 3/1953 | Lorter | 52/530 |
| 2,682,236 | A | * | 6/1954 | Homlstrom et al. | 52/529 |
| 3,058,265 | A | * | 10/1962 | Lapsensohn | 52/536 |
| 3,110,130 | A | * | 11/1963 | Trachtenberg | 52/545 |
| 3,254,460 | A | * | 6/1966 | Bowser | 52/94 |
| 3,269,075 | A | * | 8/1966 | Marini et al. | 52/522 |
| 3,412,517 | A | * | 11/1968 | Ellis et al. | 52/520 |
| 3,593,479 | A | * | 7/1971 | Hinds et al. | 52/313 |
| 3,706,172 | A | * | 12/1972 | Keith | 52/521 |
| 4,079,561 | A | * | 3/1978 | Vallee | 52/529 |
| 4,120,132 | A | * | 10/1978 | Kendrick | 52/478 |
| 4,218,857 | A | * | 8/1980 | Vallee | 52/94 |
| 4,271,652 | A | * | 6/1981 | Svensson | 52/478 |
| 4,399,643 | A | * | 8/1983 | Hafner | 52/530 |
| 4,411,120 | A | * | 10/1983 | Ellis et al. | 52/748.1 |
| 4,422,266 | A | * | 12/1983 | Slocum et al. | 52/58 |
| 4,637,189 | A | * | 1/1987 | Maria van Riet | 52/309.8 |
| 4,706,435 | A | * | 11/1987 | Stewart | 52/533 |
| 4,729,202 | A | * | 3/1988 | Ferland | 52/520 |
| 4,756,498 | A | * | 7/1988 | Frye | 248/205.3 |
| 4,864,787 | A | * | 9/1989 | Bukowski | 52/284 |

(List continued on next page.)

*Primary Examiner*—Carl D. Friedman
*Assistant Examiner*—Christy Green
(74) *Attorney, Agent, or Firm*—Dennison, Schultz & Dougherty

(57) ABSTRACT

The present invention relates to a roofing shingle, which can surely prevent water such as rainwater from leaking through a roof. A roofing shingle has a rectangular plate (11) provided with first through fourth seam portions (11*a*–11*d*). The first and second seam portions (11*a*, 11*b*) are positioned in a pair along opposite side edges of said plate and folded in opposite directions with respect to a plane of said plate. The third and fourth seam portions (11*c*, 11*d*) are positioned in a pair along opposite end edges of said plate and folded in opposite directions with respect to the plane of said plate. The roofing shingle comprises a waterproofing sheet member (20) having a sheet (21) with its configuration greater than that of said plate and adhesive layers (22*a*, 22*b*) provided on both sides of the sheet. The sheet member is positioned and adhered on the plate (11) so that a gap or space formed between the seam portion and a corresponding seam portion of an adjacent roofing shingle is closed and filled with an edge portion (21*a*, 21*d*) of the sheet.

10 Claims, 10 Drawing Sheets

U.S. PATENT DOCUMENTS 4,890,432 A * 1/1990 Shepherd ..... 52/314
5,165,211 A * 11/1992 Ottoson ..... 52/548
5,174,092 A * 12/1992 Naden ..... 52/553
5,455,099 A * 10/1995 Banner ..... 428/122
5,469,680 A * 11/1995 Hunt ..... 52/520
5,537,792 A * 7/1996 Moliere ..... 52/531
5,581,968 A * 12/1996 Laurie et al. ..... 52/538
5,613,337 A * 3/1997 Plath et al. ..... 52/533
5,642,596 A * 7/1997 Waddington ..... 52/546
5,657,603 A * 8/1997 Goodhart et al. ..... 52/519
5,711,127 A * 1/1998 Sabourin ..... 52/530
5,737,881 A * 4/1998 Stocksieker ..... 52/90.1
5,784,848 A * 7/1998 Toscano ..... 52/519
5,799,460 A * 9/1998 Jensen ..... 52/530
5,927,044 A * 7/1999 Lamb et al. ..... 52/745.19
6,173,546 B1 * 1/2001 Schafer ..... 52/522
6,505,451 B1 * 1/2003 Ksajikian ..... 52/518
6,546,687 B2 * 4/2003 Oh et al. ..... 54/409

* cited by examiner 11
11c
11d 12
12a
11c
11
11b
11a
11d
10

12
11
11a
11b

ROOFING SHINGLE

FIELD OF THE INVENTION

The present invention relates to a roofing shingle, and more particularly, to such a roofing shingle which can surely prevent water such as rainwater from leaking through a roof.

BACKGROUND OF THE INVENTION

FIG. 11 is a perspective view generally illustrating a Dutch-lap roof with use of conventional roofing shingles, the roofing shingles made of a sheet metal being successively laid on a roof board.

As shown in FIG. 11, a Dutch-lap type of roof is constructed on a house typically built in a conventional manner, and the Dutch-lap roof has an asphaltic waterproofing material 102 and a thermal insulating material (not shown) laid on a roof board 101. A plurality of shingles 104, each being made of a metallic roofing sheet, are installed on the waterproofing material 102. The metallic roofing shingles 104 are successively arranged on the waterproofing material 102, starting from a lowermost eaves plate 103, and the shingles 104 are secured to the roof board 101 at clips 105 by nails 106, respectively. Reference numerals 107, 108 denote a sub-structural flashing board and a sub-structural verge board, respectively.

Each of the roofing shingles 104 is formed in a rectangular configuration. The shingle 104 has a first seaming edge portion 104*a* downwardly folded or turned toward its back or underneath side along its longitudinal edge, and a second seaming edge portion 104*b* upwardly folded or turned toward its top or upper side along another longitudinal edge. Further, the roofing shingle 104 has a third seaming edge portion 104*c* upwardly folded or turned toward its top side in its transverse right-hand edge, and a fourth seaming edge portion (not shown) downwardly folded or turned toward its back side along its transverse left-hand edge. These seaming portions allow "flat lock seams" (or pinching lock seams) to be provided on the roof.

The conventional roof with use of such a roofing shingle might be able to effect a satisfactory waterproofing performance, so long as it is observed within a certain term of time after construction.

However, as shown in FIG. 12, a clearance or gap may be created between the shingle 104 and the asphaltic waterproofing material 102 during a long-term of use, owing to a deterioration of fixing means for the shingle, or the like. This results in a condition in that a quantity of rainwater may leak into the underside of roofing shingle through a passage of water as shown by arrows A, B. This kind of water leakage tends to be observed especially in a low-pitched part, a crest part or a curved part of a roof, and so forth. Even if the waterproofing work is executed prior to the roofing work, it is difficult to keep its waterproofing performance in a perfect condition. This is because the waterproofing material has to be partially broken by anchor screws or nails used for at least temporarily anchoring the roofing shingles in position of the substrate and the screws or nails in contact with water gradually lose its anchoring force for their rusting or deteriorating tendency.

SUMMARY OF THE INVENTION

An object of the present invention is, therefore, to provide a roofing shingle, which can surely prevent water such as rainwater from penetrating therethrough.

To achieve this object of the invention, the present invention provides a roofing shingle having a plate (11) provided with first and second seam portions (11*a*, 11*b*) positioned in a pair along opposite side edges of said plate and folded in opposite directions with respect to a plane of said plate, and third and fourth seam portions (11*c*, 11*d*) positioned in a pair along opposite end edges of said plate and folded in opposite directions with respect to the plane of said plate, comprising a waterproofing sheet member (20) having a sheet (21) with its configuration greater than that of said plate and adhesive layers (22*a*, 22*b*) provided on both of top and back sides of the sheet, said sheet member being positioned and adhered on said plate so as to make an extension area of the sheet, and edge portions (21*a*, 21*d*) of said sheet being inserted into the first and fourth seam portions (11*a*, 11*d*), whereby a gap formed between said seam portion and a corresponding seam portion of an adjacent roofing shingle is filled with said edge portion (21*a*, 21*d*) of said sheet and said extension area of the waterproofing sheet member overlaps with a corresponding waterproofing sheet member of another adjacent roofing shingle to adhere to each other.

According to the present invention, the waterproofing sheet member (20) has the sheet (21) acting as a waterproofing layer (synthetic fiber/synthetic rubber layer) on a roof board (101) and the adhesive layers (adhesive rubber layers) (22*a*, 22*b*) applied to the top and back sides of the sheet (21), as shown in FIG. 4. The sheet (21) is adhered to one side of the plate (sheet metal) (11) by the adhesive layer, as shown in FIG. 1. The edge portion (21*a*, 21*d*) of the sheet (21) is inserted into the seam portion (11*a*, 11*d*), but the other edge portion of the sheet (21) extends over the seam portion (11*b*, 11*c*) to make an outward extension area, which overlaps with a corresponding sheet of a waterproofing sheet member of another adjacent roofing shingle and which adheres thereon.

When installing the roofing shingles (YH) on the roof board, the flat lock seam portions (11*c*, 11*d*; 11*a*, 11*b*) of the roofing shingles (YH1, YH2; YH1, YH11) are engaged with each other and the extension area of the sheet member adheres to the sheet member of the adjacent shingle, as shown in FIG. 8. The edge portion (21*a*, 21*d*) of the sheet seals the upper and lower seam portions (11*c*, 11*d*; 11*a*, 11*b*) of the shingles (YH1, YH2; YH1, YH11) and the nail or screw (31) is completely sealed by the overlapping sheet members. Therefore, rainwater does not penetrate into the underside of the shingles.

BRIEF DESCRIPTION OF THE DRAWINGS

These and other objects and advantages will become more readily apparent when considered in relation to the preferred embodiments as set forth in the specification and shown in the drawings in which:

FIG. 8A and 8B illustrate an function of the roofing shingle of the first embodiment which prevents water from penetrating into the underside of the shingle, wherein FIG. 8A shows an enlarged cross-sectional view of a portion indicated by an arrow in FIG. 6B and FIG. 8B shows a cross-section taken along a line VIIIB—VIIIB in FIG. 7;

DESCRIPTION OF THE PREFERRED EMBODIMENTS

I. First Embodiment (1) Structure of Roofing Shingle

Referring to FIG. 1, a roofing shingle YH, which is a roofing component, segment or module, is generally formed in a rectangular configuration, wherein the shingle YH comprises a metallic (copper) sheet-like member or plate 10 and a waterproofing sheet member 20, each having a substantially rectangular configuration. The member 20 is provided with an adhesive material applied on the opposite sides thereof and release paper sheets covered on the adhesive material.

Figure 1A:
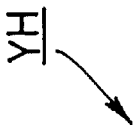
FIG. 1A, 1B and 1C show a longitudinal side elevation, a plan view and a transverse side elevation of a roofing shingle according to a first embodiment of the present invention.
Figure 1A:
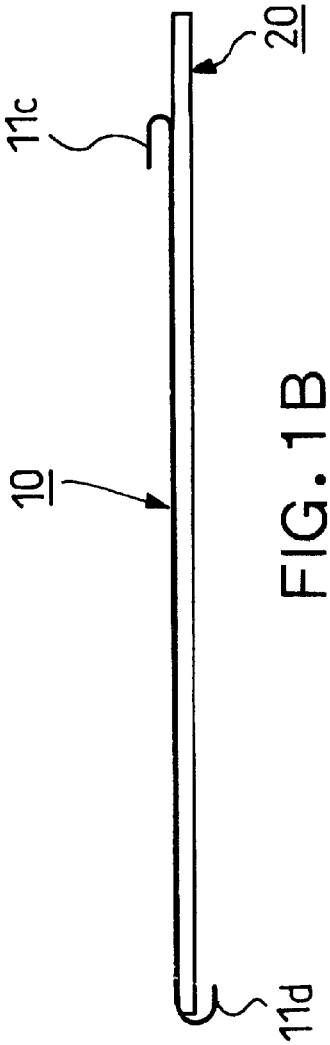
Figure 1B:
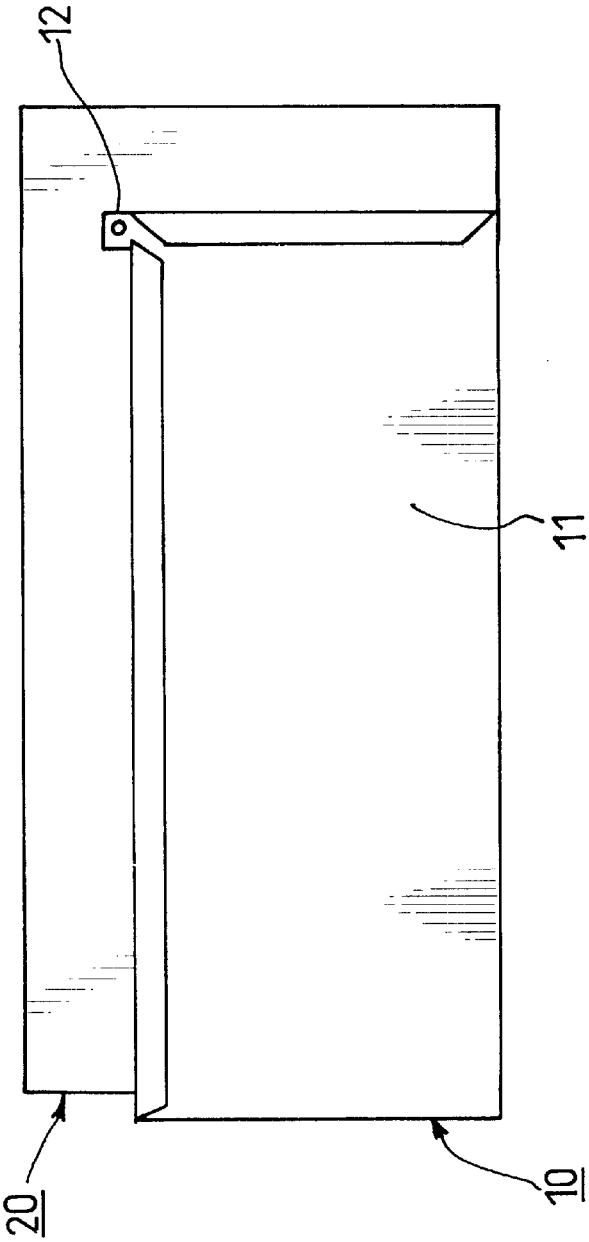
Figure 1C:
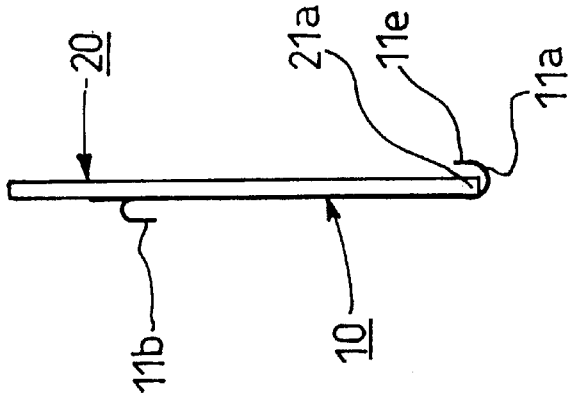
Figures 2A, 2B, 2C:
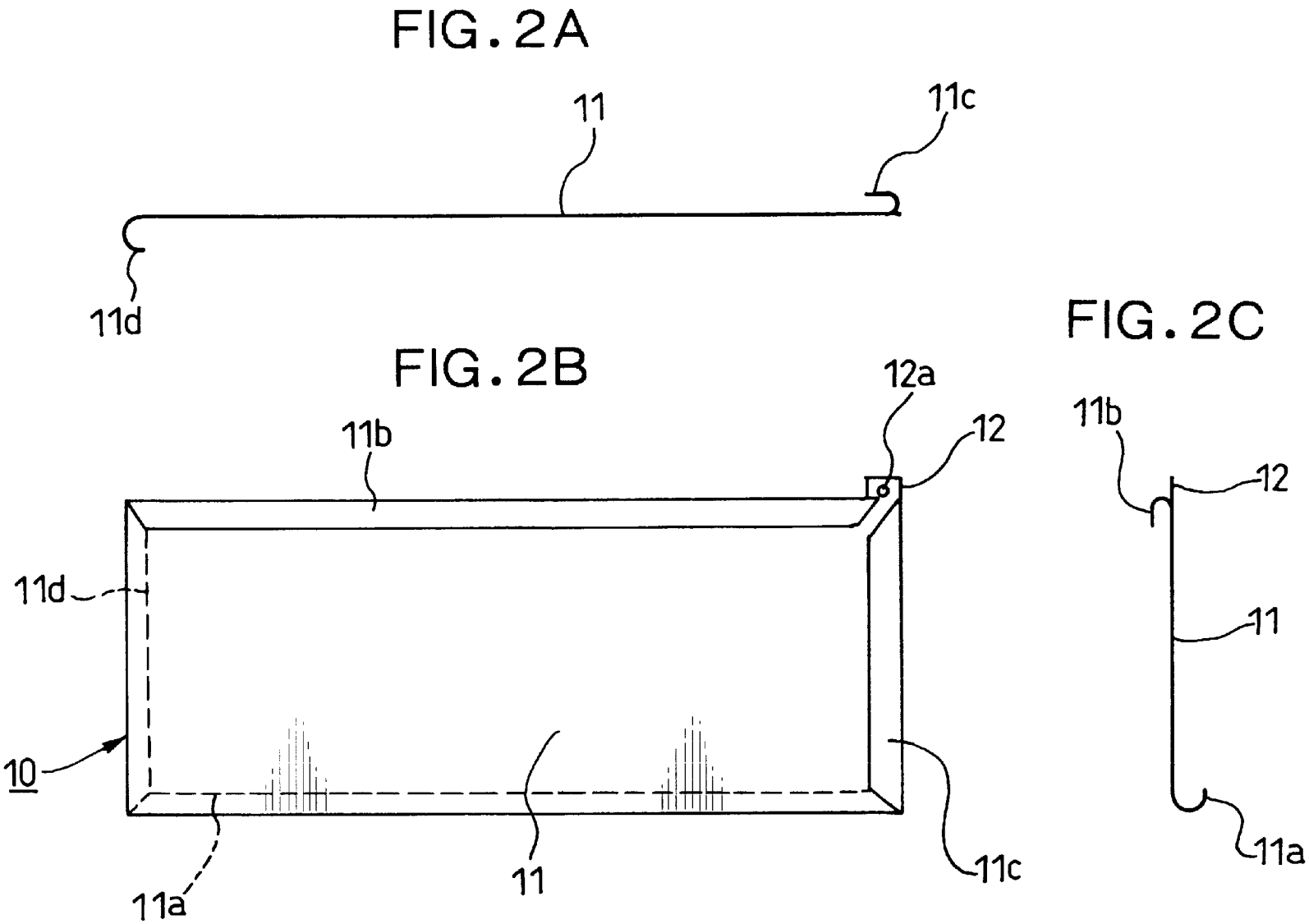
FIG. 2A, 2B and 2C show a longitudinal side elevation, a plan view and a transverse side elevation of a metal plate in the first embodiment.

Referring to FIG. 2, the metallic plate 10 is a panel formed in a generally rectangular profile by a rectangle-shaped sheet metal 11, which is substantially rigid but elastically deformable. The sheet metal 11 has a first seam portion or flat lock seam portion 11*a* which is downwardly folded or turned toward its back side along its longitudinal edge, and a second seam portion 11*b* which is upwardly folded or turned toward its top or front side along another longitudinal edge. The sheet metal 11 also has a third seam portion 11*c* upwardly folded or turned toward its top side along its transverse edge and a fourth seam portion 11*d* downwardly folded or turned toward its back or underneath side along another transverse edge. These seam portions are formed to have a U-shaped cross-section for "flat lock seam" (or pinching lock seam).

Figure 11:
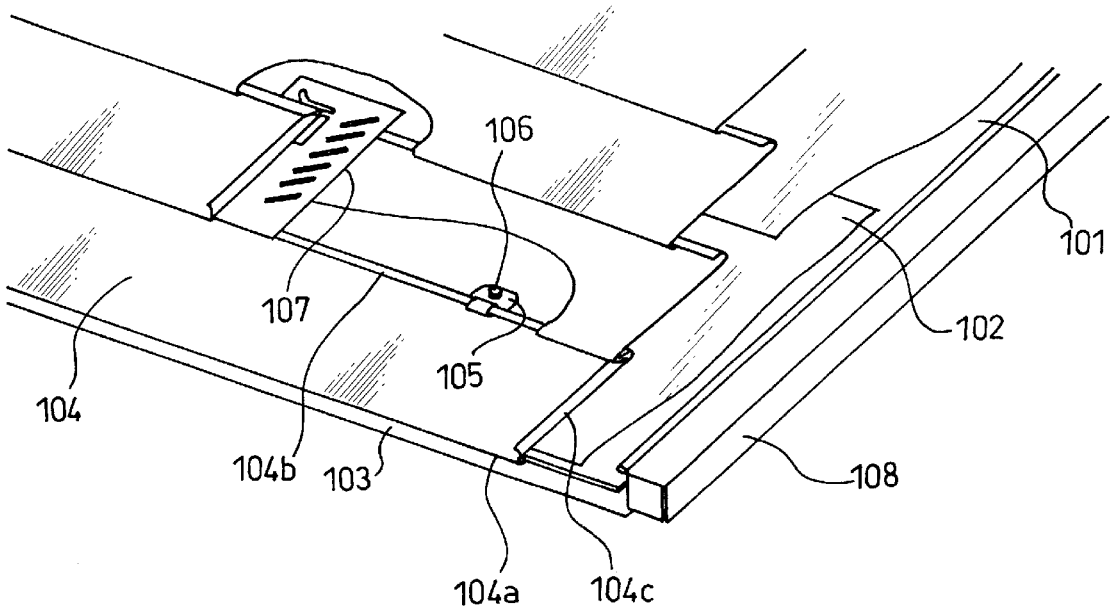
FIG. 11 shows a perspective view, partially broken away, of a roofing shingle of the prior art.
Figure 12:
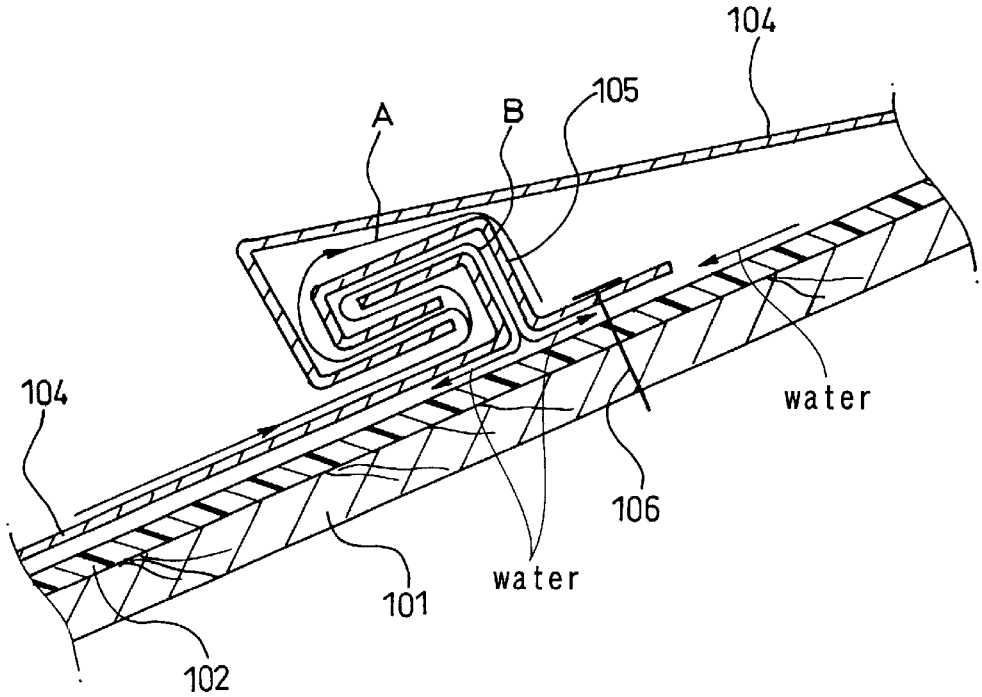
FIG. 12 shows an enlarged cross-sectional view of the conventional roofing shingle, in which a state of rainwater leakage is illustrated.

The sheet metal 11 is provided with a nailing portion 12 outwardly extending therefrom at an upper-right corner. The nailing portion 12 has a central aperture 12*a*, which is used for at least temporarily fixing the roofing shingle on a roof board by a nail (not shown). The nailing portion 12 is formed by an extension of the sheet metal 11 and effects the same functions as in the clip 105 of the prior art (see FIG. 11). Since provision of the clip can be omitted in the present embodiment, a saving in manufacturing cost and a decrease in the number of parts to be installed can be achieved.

Figure 3A:
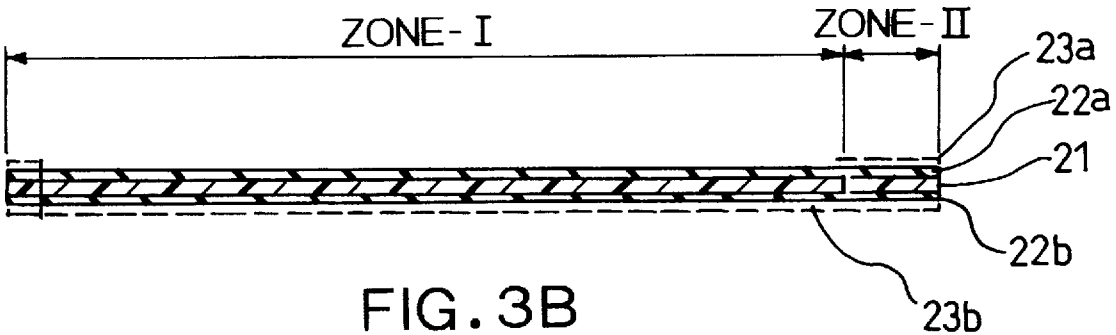
FIG. 3A, 3B and 3C show a longitudinal side elevation, a plan view and a transverse side elevation of a waterproofing sheet member in the first embodiment.
Figure 3B:
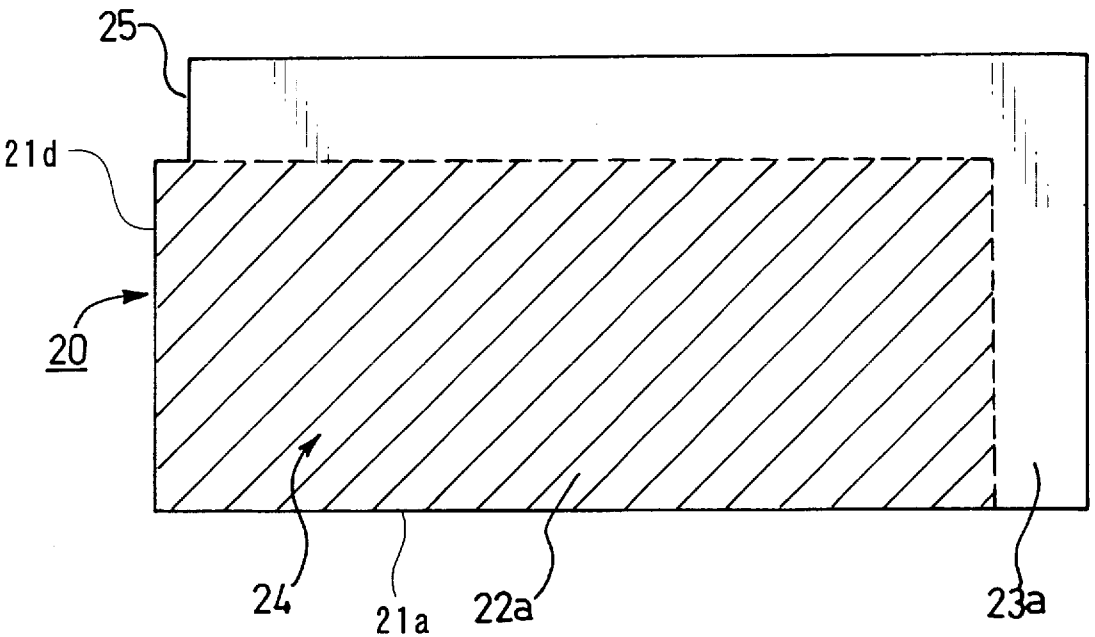
Figure 3C:
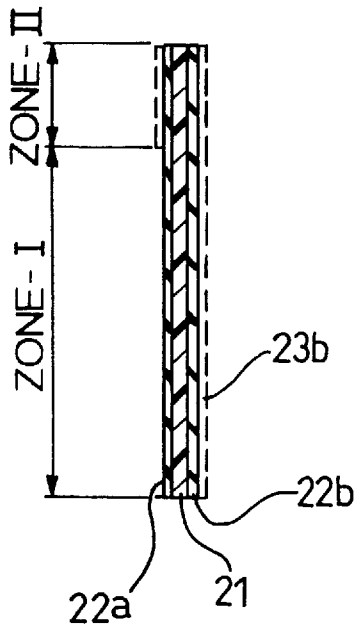
Figure 4:
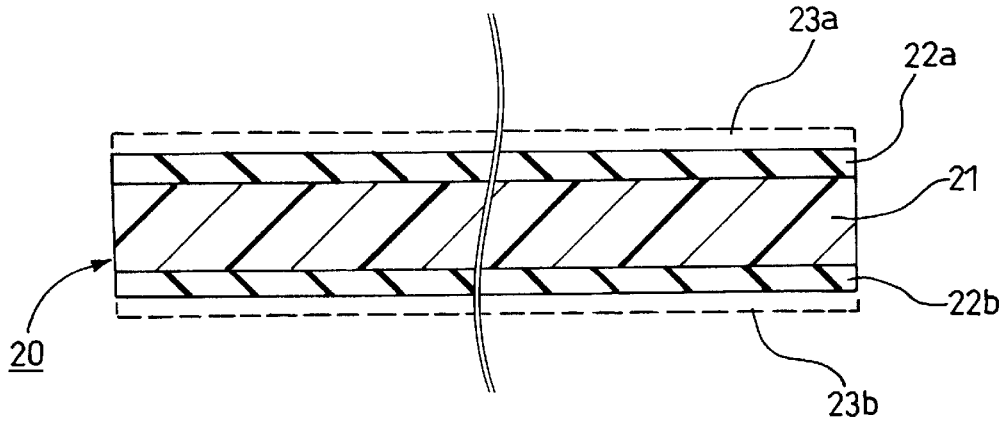
FIG. 4 shows an enlarged cross-sectional view of the waterproofing sheet member.

As shown in FIGS. 3 and 4, the waterproofing sheet member 20 has an elastic waterproofing core layer 21 made from a synthetic fiber and a synthetic rubber. The waterproofing sheet member 20 has a generally rectangular profile greater than that of the sheet metal 11 to make an extension extending across the third and fourth seam portions 11*b*, 11*c*. The waterproofing sheet member 20 is provided with a top adhesive rubber layer 22*a* on the top side surface of member 20 and a top release paper sheet 23*a* over the layer 22*a*. The waterproofing sheet member 20 is further provided with a back adhesive rubber layer 22*b* on the underside of the member 20 and a back release paper sheet 23*b* over the layer 22*b*. A synthetic rubber sheet or rubber/asphalt sheet with adhesive layers, e.g., Gamlon MG base B manufactured by TAJIMA ROOFING Co. Ltd. is preferably employed as the waterproofing sheet member 20.

Referring now to FIG. 3, an exposed area 24 of the waterproofing sheet member 20 is illustrated as a hatched rectangle as indicated by zone-I, in which the top release paper sheet 23*a* is preliminarily removed or peeled from the waterproofing sheet member 20, so that the top adhesive rubber layer 22*a* is uncovered therein. In the area as indicated by zone II, the layer 22*a* remains covered with the sheet 23*a*. The uncovered area 24 allows the waterproofing sheet member 20 to be preliminarily adhered to the underside of the sheet metal 11 as shown in FIG. 1. The member 20 and the sheet metal 11 are positioned relatively to each other and integrally combined with each other in such a manner that a notch 25 is formed at the upper-left corner of the shingle YH. The notch 25 is used to temporarily expose the nailing portion 12 of the adjacent sheet metal 11 during the roofing work, as shown in FIG. 6B, and is adapted to adjust or regulate the thickness of the roofing. The lower-left corner of the plate 10 as seen in FIG. 2 has a configuration identical with a configuration of the corresponding corner of the member 20 as seen in FIG. 3, and the member 20 and the plate 10 are aligned with each other along their edges as shown in FIG. 1.

The left and lower edge portions of the sheet member 20 are inserted into the U-shaped seam portions 11*a*, 11*d* to an extent that the edges of the member 20 is in close proximity to the edges of the seam portions 11*a*, 11*d*.

(2) Roofing Process

Figure 5:
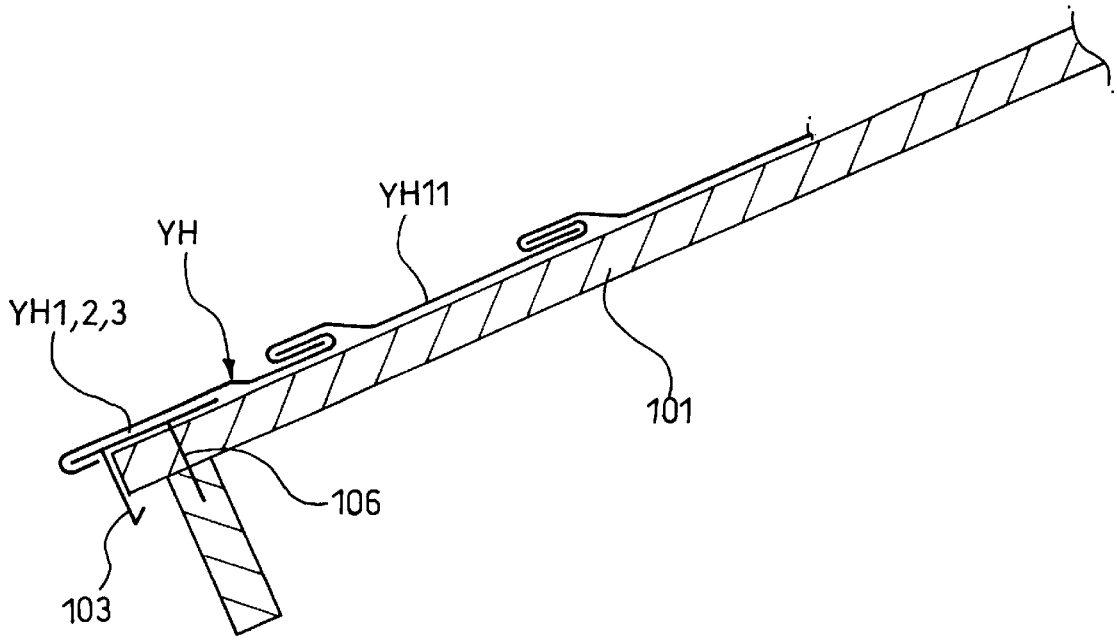
FIG. 5 shows a cross-section of the roof constructed with use of the roofing shingle of the first embodiment.

The process of roofing (Dutch-lap roofing) will be described hereinafter with reference to FIGS. 5–8. In FIG. 5, a cross-section of the structure after construction is illustrated. In FIGS. 6–8, it is assumed that the basic structure including the eaves part 103 has been already constructed.

Figure 6A:
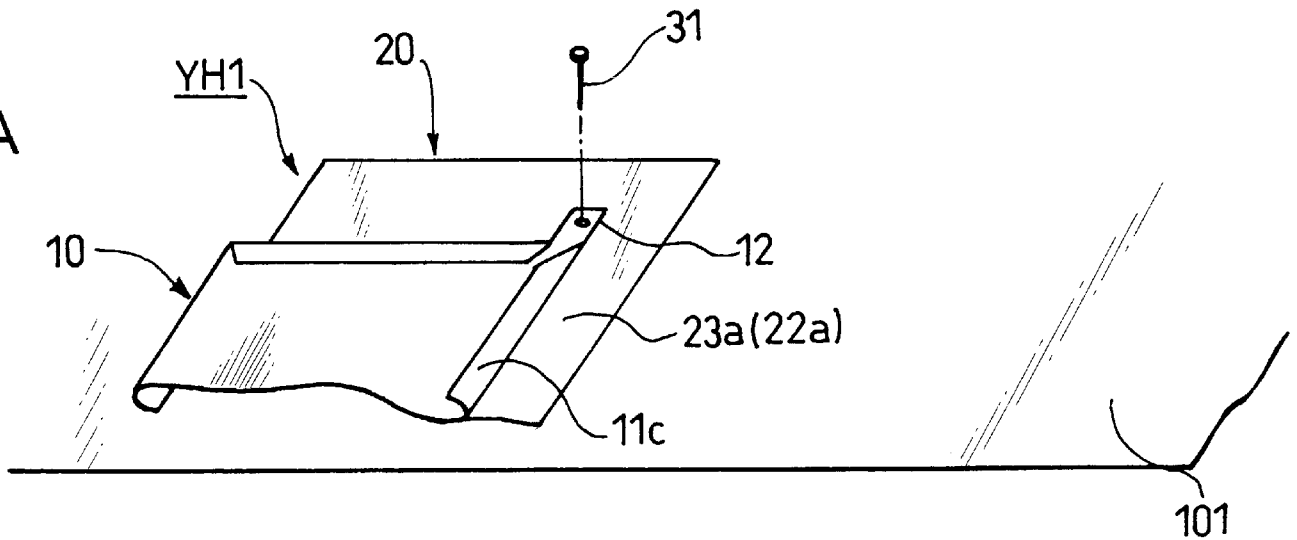
FIG. 6A and 6B illustrate the process of constructing the roof with use of the roofing shingle of the first embodiment.
Figure 6B:
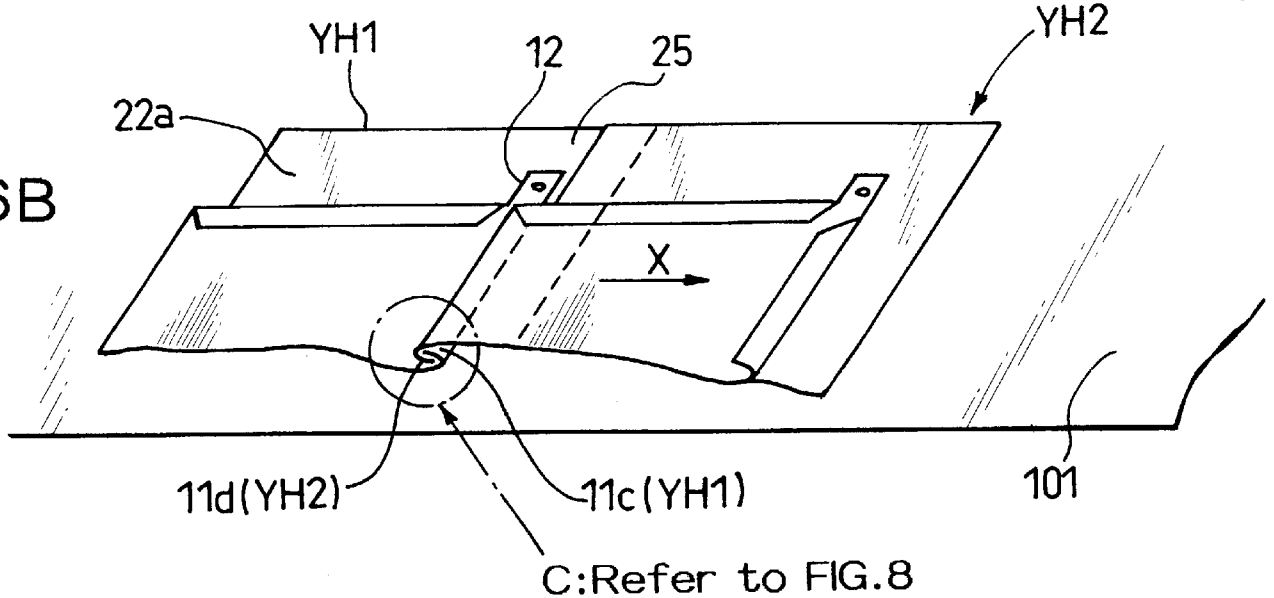
Figure 7:
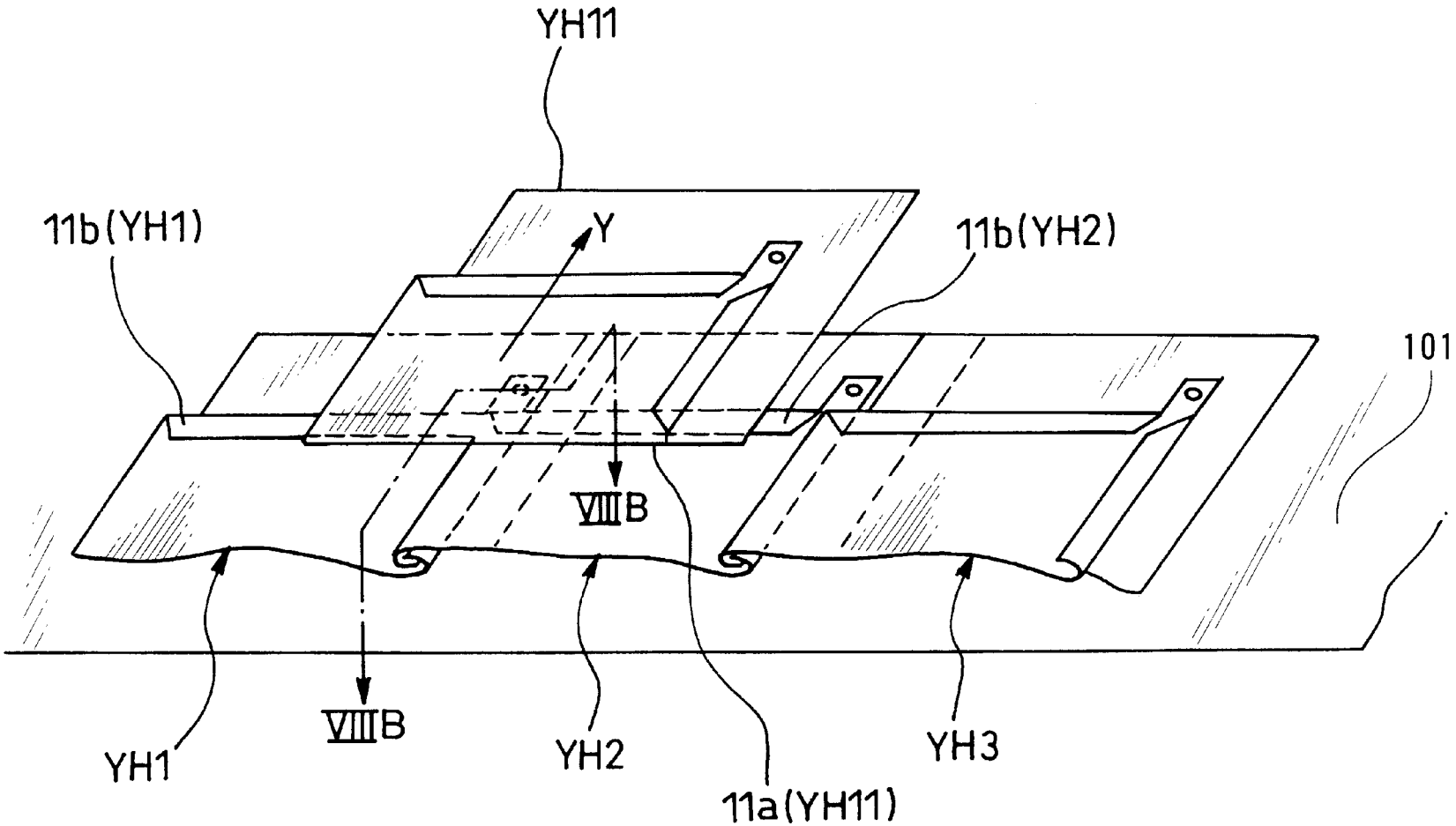
FIG. 7 illustrates the roofing process continuing the process shown in FIG. 6.

The back release paper sheet 23*b* (FIG. 4) of a first roofing shingle YH1 is removed and the shingle YH1 is positioned and adhered on a roof board 101 in a predetermined orientation along the eaves part 103, as shown in FIG. 6A. A nail 31 made of stainless steel is then driven into the roof board 101 through the aperture 12*a* of the nailing portion 12 so as to anchor the roofing shingle YH1 on the board 101. Thereafter, the top release paper sheet 23*a* in the zone II having an L-shaped configuration is removed from the shingle YH1 so that the member 20 is uncovered in a formation of L-shape to expose the layer 22*a*.

Referring to FIG. 6B, a second roofing shingle YH2, from which the bottom release paper sheet 23*b* has similarly been removed, is then adhered to the roof board 101 in a position adjacent to the shingle YH1, while the second roofing shingle YH2 is displaced in a direction shown by arrow X in FIG. 6B, in a condition that the fourth seam portion 11*d* of the shingle YH2 is engaged with the third seam portion 11*c* of the first roofing shingle YH1 and that the shingles YH1, YH2 are longitudinally aligned with each other. The layer 21 of the second shingle YH2 overlaps the zone II, i.e., the extension area of the layer 21 of the first shingle YH1, as shown in FIG. 8A.

Figure 8A:
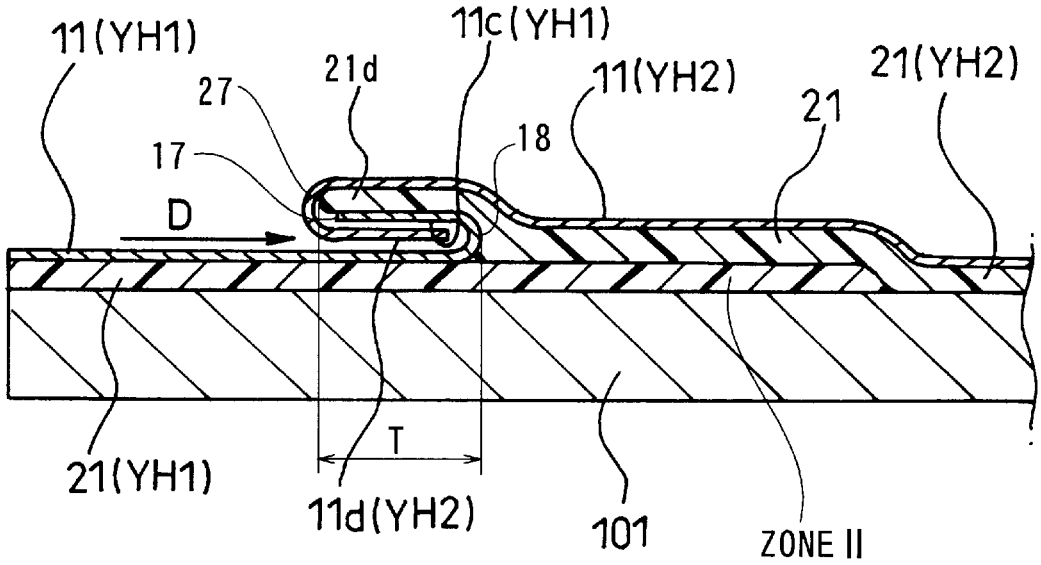

The interlocking mechanism is shown in FIG. 8A, which is an enlarged cross-sectional view of the part C shown in FIG. 6B. The left edge portion 21*d* of the second synthetic fiber/synthetic rubber layer 21 (YH2) closes and sealingly fills a space or gap formed between the third seam portion 11*c* of the first sheet metal 11 (YH1) and the fourth seam portion 11*d* of the second metal sheet 11 (YH2). Therefore, rainwater flowing in a direction of an arrow D can be surely blocked by the left end 21*d* of the layer 21, and does not penetrate therethrough to reach the roof board 101. Thus, a rainwater leakage of the roof is surely prevented from occurring. Preferably, a leading edge 27 of the layer 21 of the shingle YH2 outwardly extends across an edge 17 of the seam portion 11*c*, and the distance T between the edge 27 and an apex 18 of the seam portion 11*c* of the shingle YH1 is equal to or greater than 10 mm.

In accordance with the steps and the engagement manner as set forth above, the other roofing shingles YH are successively placed and anchored on the roof board 101 until the first stage of roofing shingles YH1, YH2, YH3 . . . are provided in a row along the eaves part 103 of the roof.

Figure 8B:
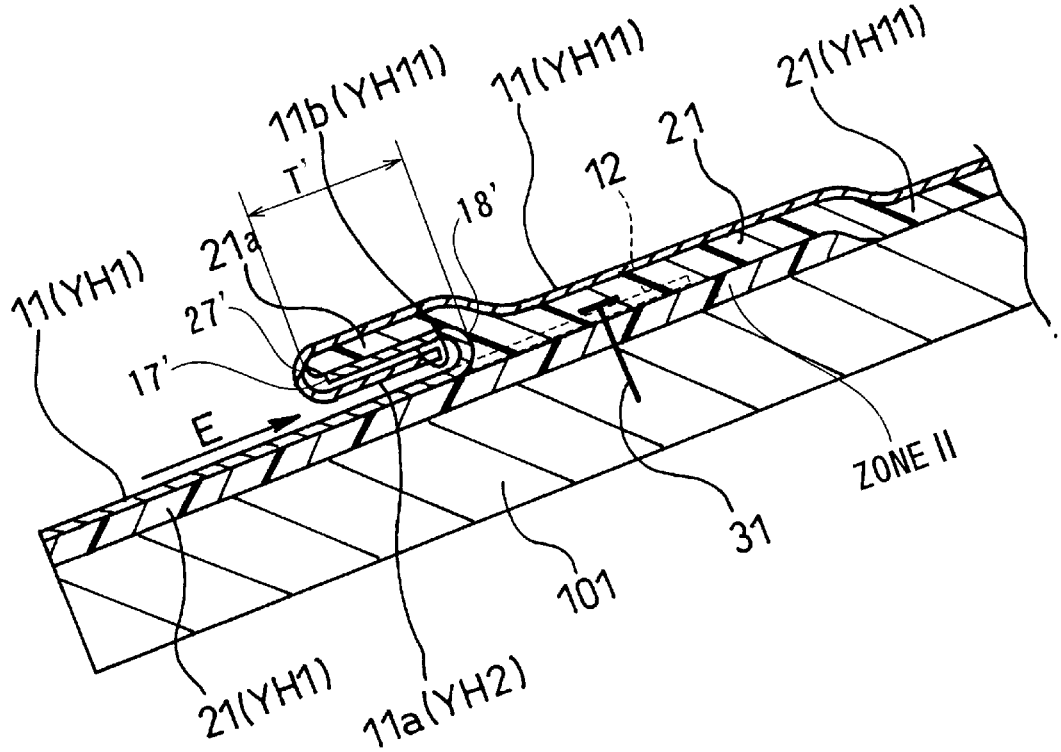

Referring next to FIG. 7, a roofing shingle YH11 for the second roofing stage, from which the back release paper sheet 23*b* has been removed, is adhered and anchored onto the roof board 101 in a condition that the first seam portions 11*a* of the roofing shingle YH11 is aligned and equally engaged with the second seam portions 11*b* of the roofing shingles YH1, YH2. In the setting step of the shingle YH11, the shingle YH11 is upwardly displaced in a direction of arrow Y in a condition that the first seam portion 11*a* of the shingle YH11 is in an interlocking engagement with the second seam portions 11*b* of the shingles YH1, YH2. The engagement manner of the seam portions 11*a*, 11*b* are shown in FIG. 8B. The edge portion 21*a* of the layer 21 of the shingle YH11 closes and sealingly fills a space or gap formed between the second seam portion 11*b* of the shingle YH1 installed in the first roofing stage and the seam portion 11*a* of the shingle YH11 installed in the second roofing stage. The extension area, i.e., the zone II of the layer 21 of the shingle YH1 overlaps the layer 21 of the shingle YH11, as shown in FIG. 8B. The stainless steel nails 31 and nailing portions 12 of the sheet metals 11, which have been already secured in the first roofing stage, is completely covered with the layers 21 of the shingle YH11 installed in the second roofing stage. Preferably, a leading edge 27' of the layer 21 of the shingle YH11 outwardly extends across an edge 17' of the seam portion 11*b*, and the distance T' between the edge 27' and an apex 18' of the seam portion 11*b* of shingle YH1 is equal to or greater than 10 mm.

Rainwater flowing in a direction of an arrow E is blocked by the edge portion 21*a* of the shingle YH11. The stainless steel nails 31 and nailing portions 12 of the shingle YH1 are completely covered with the layers 21 of the shingle YH11, and therefore, the rainwater does not reach the roof board 101. Thus, the rainwater is surely prevented from penetrating through a series of roofing shingles YH.

After the roofing process for the second roofing stage has been completed, roofing works for the third, fourth and further roofing stages are successively carried out to complete the whole roof as shown in FIG. 5, wherein the roofing shingles YH are placed and anchored in the manner as set forth above.

II. Second Embodiment

The first embodiment relates to the roofing shingle adhered on the roof board. However, the second embodiment relates to a roofing shingle further comprising means for preventing an expansion or bulge of waterproofing sheet, which may be caused by moisture vapor generating from a concrete substrate in a case where the roofing shingle is mounted on the concrete substrate.

Figure 9A:
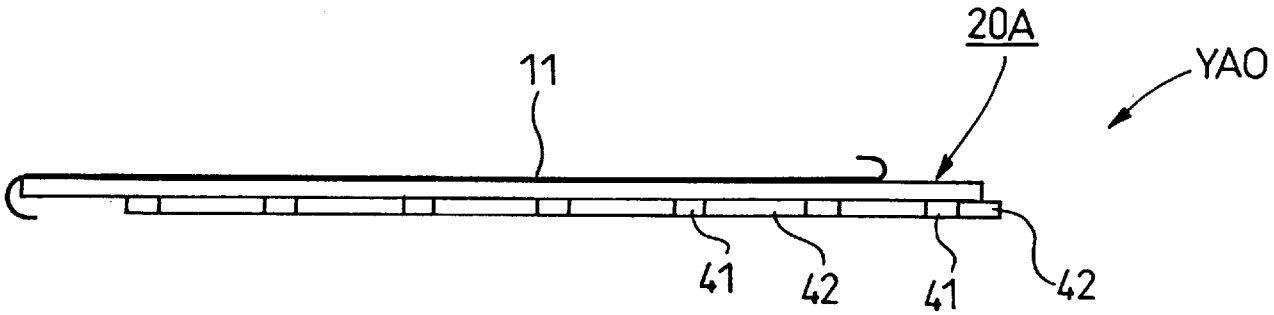
FIG. 9A, 9B and 9C show a longitudinal side elevation, a plan view and a transverse side elevation of a roofing shingle according to a second embodiment of the present invention.
Figure 9B:
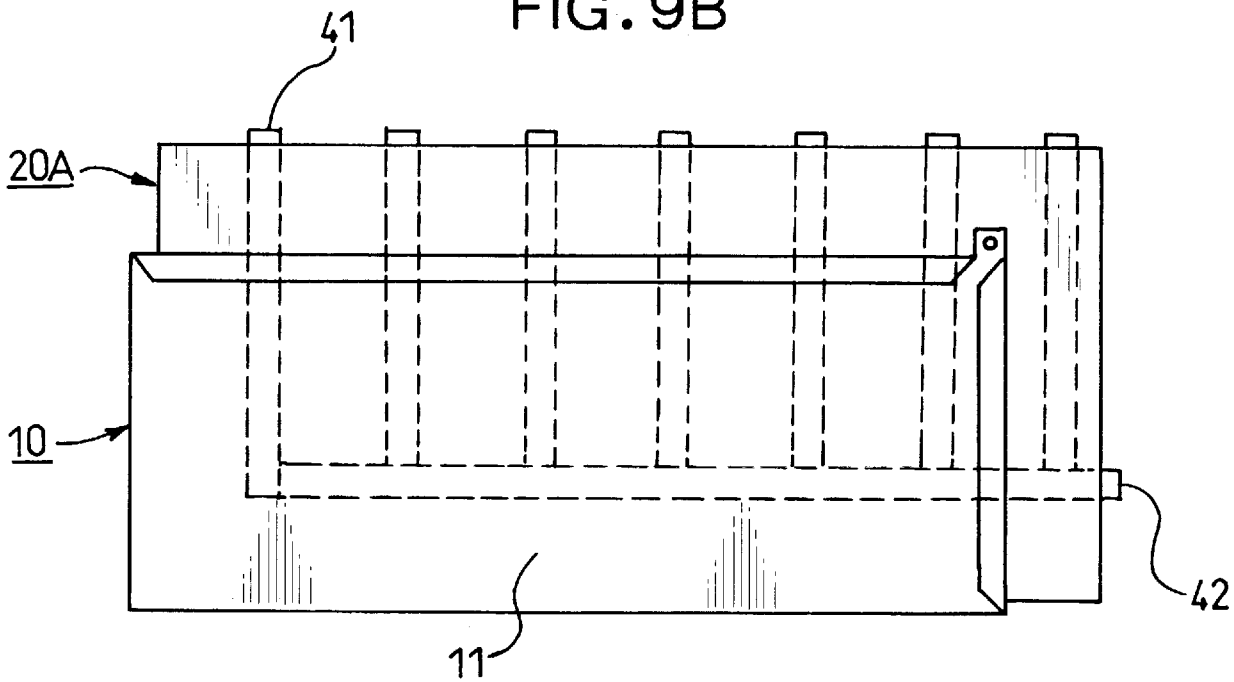
Figure 9C:
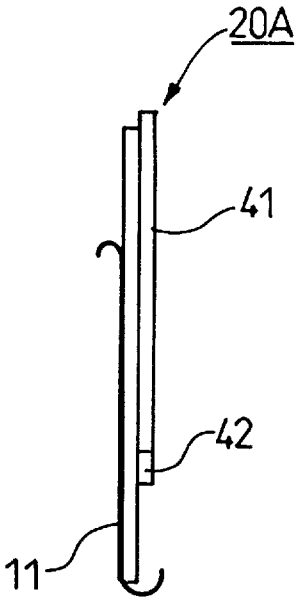
Figure 10:
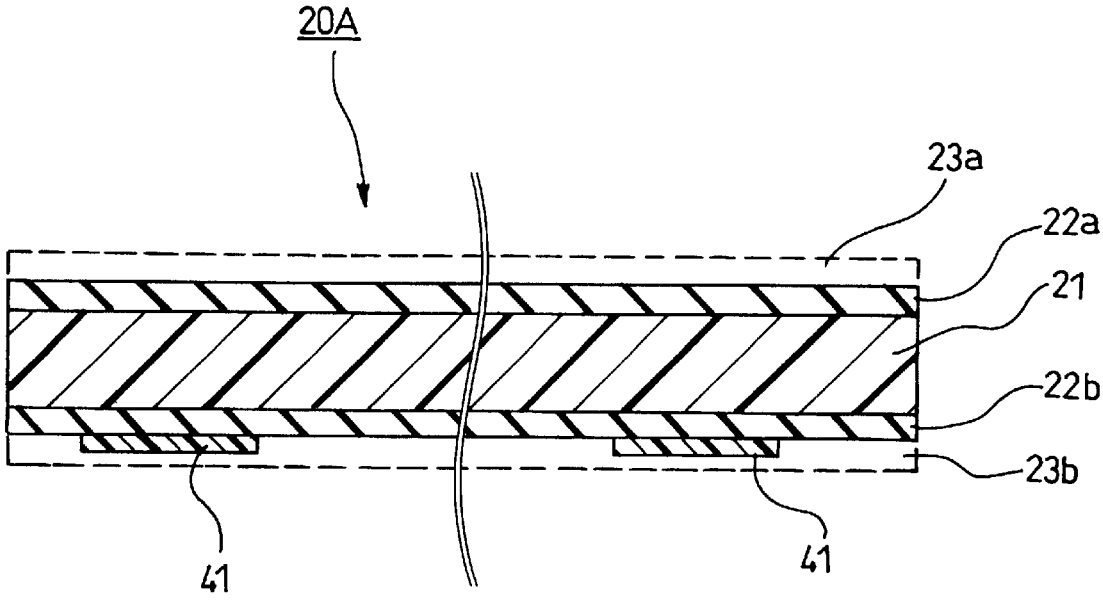
FIG. 10 shows an enlarged cross-section of the waterproofing sheet member according to the second embodiment.

According to the second embodiment, a roofing shingle YH0 comprises a metallic plate 10 and a waterproofing sheet member 20A, as shown in FIGS. 9 and 10.

The waterproofing sheet member 20A comprises a back adhesive rubber layer 22*b* as in the first embodiment, a plurality of nonwoven fabric belts or liner menders 41 integrally attached to the underside surface of the layer 22*b*. The belts 41 are spaced apart from each other, in parallel with each other. The other nonwoven fabric belts or liner menders 42 are similarly attached to the underside surface of the layer 22*b*, the belts 42 extending in a direction perpendicular to the belts 41 and connecting with the belts 41 at their ends. A set of the belts 41, 42 acts as a cushioning member. As the nonwoven fabric, TEXTOGLASS (glass fiber fabric) is preferably employed, which is available from KANEBO Co. Ltd.

When such a roofing shingle YH0 is placed on a concrete substrate, an expansion or bulge of the material is preventing from occurring in the roofing shingle YH0, since the moisture vapor from the concrete substrate is absorbed and dispersed by fluid passages of the nonwoven fabric belts and exhausted to the atmosphere therethrough.

As will be apparent from the foregoing, the present invention provides an improved roofing shingle which can perform a substantially perfect waterproofing function for a long time without maintenance, since the roofing shingle can prevent a leakage of rainwater and a peeling off from the roof even in a strong wind and rain upon a typhoon, hurricane or the like.

Further, the present invention allows the waterproofing and roofing works to be performed at the same time and therefore, the cost of construction work can be reduced.

Furthermore, the present invention may be applied to various types of roof, such as M-shaped roof, Y-shaped roof, low-pitched roof, curved roof, arch roof, doomed roof in addition to the normal gable, shed or pent roof, since a substantially perfect waterproofing function can be surely achieved.

In addition, as the waterproofing sheet member is integrally combined with the roofing shingle, the waterproofing sheet member follows and cushions a motion of the substrate involved in cracks or the like. Therefore, the roofing shingle and the waterproofing sheet member thereof are not broken by the action or motion of the substrate.

It is understood that this invention is not to be limited to the particular embodiments shown and described above, since many modifications may be made, and it is contemplated by the appended claims to cover such modifications as fall within the true spirit and scope of this invention.

Although the embodiments have been described as to the roofing shingles of rectangular configuration, the present invention may similarly be applied to any of various other configurations such as square or rhombus. Thus, the present invention may also be applied to a diagonal roofing as well as the Dutch-lap roof as set forth above.

Although the aforementioned roofing shingles are made of a sheet metal (copper), the present invention may similarly be applied to plates made of various other materials, such as plastic sheets, flat tiles and slate tiles.

Moreover, the present invention may be applied to a wide range of products from a high-quality roofing shingle to an economical roofing shingle, in dependence on the selection of sheet metal. As the sheet metal, various kinds of metal, such as titanium, stainless steel, aluminum and iron, in addition to copper, may be adopted. Further, a thin sheet metal can be used for reducing the costs of raw material and manufacture.

In addition, the shingle in the aforementioned embodiment is provided with the nailing portion which temporarily hold the shingle in position. However, the shingle may be provided with a plurality of nailing portions, or the nailing portion may be omitted from the shingle. Further, a clip or clips of a conventional structure may be used for anchoring the shingle on the roof board.

What is claimed is:

1. A roofing shingle having a plate (11) provided with first and second seam portions (11*a*, 11*b*) positioned in a pair along opposite side edges of said plate and folded in opposite directions with respect to a plane of said plate, and third and fourth seam portions (11*c*, 11*d*) positioned in a pair along opposite end edges of said plate and folded in opposite directions with respect to the plane of said plate, comprising a waterproofing sheet member (20) having a sheet (21) with its configuration greater than that of said plate and adhesive layers (22*a*, 22*b*) provided on both of top and back sides of the sheet, said sheet member being positioned and adhered on said plate so as to make an extension area of the sheet, and edge portions (21*a*, 21*d*) of said sheet being inserted into the first and fourth seam portions (11*a*, 11*d*), whereby a gap formed between said seam portion and a corresponding seam portion of an adjacent roofing shingle is filled with said edge portion (21*a*, 21*d*) of said sheet and said extension area of the waterproofing sheet member overlaps with a corresponding waterproofing sheet member of another adjacent roofing shingle to adhere to each other.

2. A roofing shingle according to claim 1, wherein a configuration of a corner of said sheet adhered on said plate is coincident with a configuration of a corner of said plate and the corner of said sheet is overlaid on the corner of said plate.

3. A roofing shingle according to claim 2, wherein said plate (11) is provided with an extending part (12) with an aperture (12*a*) through which an anchoring member (31) extends.

4. A roofing shingle according to claim 1, further comprising a release member applied to cover said adhesive layer in said extension area of said sheet.

5. A roofing shingle according to claim 1, further comprising means for cushioning the roofing shingle and venting a backside area of the shingle, which is provided on a backside of said sheet.

6. A roofing shingle according to claim 1, wherein said plate is made of a sheet metal.

7. A roofing shingle according to claim 3, wherein said sheet is provided with a notch (25) in said extension area so that said extending part (12) of an adjacent roofing shingle is uncovered with said sheet.

8. A roofing shingle according to claim 1, wherein said seam portion (11*a*, 11*b*, 11*c*, 11*d*) is adapted to be brought into interlocking engagement with the corresponding seam portion of an adjacent roofing shingle by relatively displacing one of the roofing shingles, whereby said gap is filled with said edge portion (21*a*, 21*d*) of said sheet (21).

9. A roofing shingle according to claim 1, wherein said edge portion (21*a*, 21*d*) is inserted into said seam portion to an extent that the overlapping distance (T) of a leading edge (27, 27') of said edge portion (21*a*, 21*d*) and an apex (18, 18') of a seam portion of said adjacent shingle is at least 10 mm.

10. A roofing shingle according to claim 1, wherein a leading edge (27, 27') of said edge portion (21*a*, 21*d*) is inserted into said seam portion to an extent that said leading edge is in close proximity to a turning part (17, 17') of said seam portion (11*a*, 11*d*).

* * * * *